US008447210B2

(12) United States Patent
Montfort et al.

(10) Patent No.: US 8,447,210 B2
(45) Date of Patent: May 21, 2013

(54) REUSABLE TRANSFER ASSIST BLADE ASSEMBLY FOR ELECTRO-PHOTOGRAPHIC MARKING DEVICES

(75) Inventors: David B. Montfort, Webster, NY (US); Donald C. Koch, Ontario, NY (US); Eliud Robles Flores, Webster, NY (US); John R. Falvo, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 337 days.

(21) Appl. No.: 12/885,623

(22) Filed: Sep. 20, 2010

(65) Prior Publication Data

US 2012/0070203 A1 Mar. 22, 2012

(51) Int. Cl.
*G03G 15/16* (2006.01)

(52) U.S. Cl.
USPC ..... 399/121; 399/109

(58) Field of Classification Search
USPC ..... 399/109, 121, 107, 316, 350, 351, 399/274, 284, 297
See application file for complete search history.

(56) References Cited

U.S. PATENT DOCUMENTS 5,218,412 A * 6/1993 Martin ..... 399/351
2007/0212130 A1 * 9/2007 Kuwabara et al. ..... 399/316

* cited by examiner

*Primary Examiner* — Sophia S Chen
(74) *Attorney, Agent, or Firm* — Fay Sharpe LLP

(57) ABSTRACT

As set forth herein, a reusable transfer assist blade (TAB) assembly includes a replaceable blade assembly that is locked into position between a clamp assembly and an extruded portion of the TAB assembly. When the blade assembly requires replacement, spring tables on the clam assembly are biased upward to release the clamp assembly from the extruded portion, and the clamp assembly is rotated about a clamp tab-clamp pocket interface at the top of the TAB assembly. The blade assembly is removed and replaced, the clamp assembly is rotated back into position against the extruded portion, and the spring tabs re-engage interlocking features on the extruded portion to lock the replacement blade in position. The expensive extruded portion and clamp assembly are thus reused and the inexpensive blade assembly is discarded or recycled.

19 Claims, 6 Drawing Sheets

REUSABLE TRANSFER ASSIST BLADE ASSEMBLY FOR ELECTRO-PHOTOGRAPHIC MARKING DEVICES

TECHNICAL FIELD

The present exemplary embodiments broadly relate to a transfer assist blade (TAB) assembly for a marking device. However, it is to be appreciated that the present exemplary embodiments are also amenable to other devices and other applications.

BACKGROUND

The process of transferring charged toner particles from an image bearing member marking device (e.g. photoreceptor) to an image support substrate (e.g., sheet) involves overcoming cohesive forces holding the toner particles to the image bearing member. The interface between the photoreceptor surface and image support substrate is not always optimal. Thus, problems may be caused in the transfer process when spaces or gaps exist between the developed image and the image support substrate. A critical aspect of the transfer process is focused on the application and maintenance of high intensity electrostatic fields in the transfer region for overcoming the cohesive forces acting on the toner particles as they rest on the photoreceptive member. Careful control of these electrostatic fields and other forces is required to induce the physical detachment and transfer-over of the charged toner particles without scattering or smearing the developer material. Mechanical devices that force the image support substrate into intimate and substantially uniform contact with the image bearing surface have been incorporated into transfer systems. Various contact blade arrangements have been proposed for sweeping the backside of the image support substrate, with a constant force, at the entrance to the transfer region.

Today, field replacement of a TAB assembly needs to be done in a manner that is very robust and practical, and that meets the specific requirements of the conventional assembly. The TAB assembly has to translate extremely quickly in order to achieve the high speed (e.g., 7 msec) motion necessary to avoid sweeping into the inter-document zone process patches. Therefore, low mass is desirable to prevent the stepper motor from an over torque condition, which leads to skipped "steps", causing a fault. However, in conventional TAB assemblies, the clamp/post assembly is thick and has an undesirably high mass in order to be rigid enough to support the translation speeds required.

Some spring-type clamps have been attempted but are not practical given that the clamp needs to be structurally supportive (for both the blade and posts), and electrically conductive to the lower semi conductive blade layer. Additionally, such "springs" are typically a thick (~2.5 mm) sheet metal feature that is sectioned to allow flexure. As such, these springs cannot be compressed enough to provide a biasing force against the blade after riding past the ramp detent (the force is undesirably large and causes a non parallel point contact). In addition, in classical assemblies the upper section of the clamp that biases the blade into the extrusion does not provide a substantially secure and controlled position to maintain a proper 90 degree blade angle.

One known TAB assembly is a high frequency service interval (HFSI) part that has a HFSI replacement life of one million prints. The feature within the TAB assembly that fails or wears out is often a compliant blade subassembly that rides against the backside of the sheet during the Transfer process. This action, over time, even though the blade incorporates an UHMW (ultra high molecular weight) wear layer, eventually renders the blade out of specification for critical design dimensions, ultimately leading to image quality (IQ) defects. The common approach is to replace the entire TAB assembly at one million prints with a new part at a cost of about $80 each.

There is an unmet need in the art for a TAB assembly with a replaceable blade subassembly that can be replaced while the rest of the TAB assembly is retained, thereby reducing replacement costs and waste.

BRIEF DESCRIPTION

In one aspect, a transfer assist blade (TAB) assembly comprises a replaceable blade assembly, an extruded portion against which the replaceable blade assembly is biased, and a clamping assembly comprising a plurality of spring tabs that releasably interlock with the extruded portion to secure the replaceable blade assembly in an operational position between the extruded portion and the clamping assembly.

In another aspect, a replaceable blade assembly for a transfer assist blade (TAB) assembly comprises a blade proper that applies pressure on a passing print medium during printing, and a mounted blade portion with apertures therein through which spring tabs on a clamp assembly pass, and which is removably mounted between the clamp assembly and an extruded portion of the TAB assembly. The replaceable blade assembly further comprises a perforated portion between the mounted blade portion and the blade proper, the perforated portion being flexible to create an approximately 90° angle between the mounted blade portion and the blade proper when biased against an inner face of the extruded portion.

In yet another aspect, a method of replacing a blade assembly while reusing a transfer assist blade (TAB) assembly in which the TAB is mounted comprises monitoring wear of a blade proper on the blade assembly, determining that the blade assembly requires replacement, biasing a plurality of spring tabs on a clamp assembly upward to disengage the spring tabs from a corresponding plurality of interlocking features on an extruded portion of the TAB assembly, and rotating the clamp assembly away from the extruded portion about one or more clamp pockets at a top of the extruded portion. The method further comprises removing the blade assembly requiring replacement, positioning a replacement blade assembly on the clamp assembly, and inserting a plurality of clamp tabs on the clamp assembly into the plurality of clamp pockets on the extruded portion. Additionally, the method comprises rotating the clamp assembly toward from the extruded portion about the one or more clamp pockets at the top of the extruded portion, and snapping the spring tabs into the interlocking features to lock the replacement blade assembly in position between the clamp assembly and the extruded portion.

DETAILED DESCRIPTION

The systems and methods described herein can be utilized to reduce transfer assist blade replacement costs. With the described TAB assembly, users can reuse all of the components within the top level TAB assembly, less the replaceable compliant blade subassembly, which has a part cost of less than 9% of the current total price of the entire TAB assembly. The design of this reusable assembly incorporates simple yet robust features that allow for quick field replacement, saving considerable cost and landfill waste.

Figure 1:
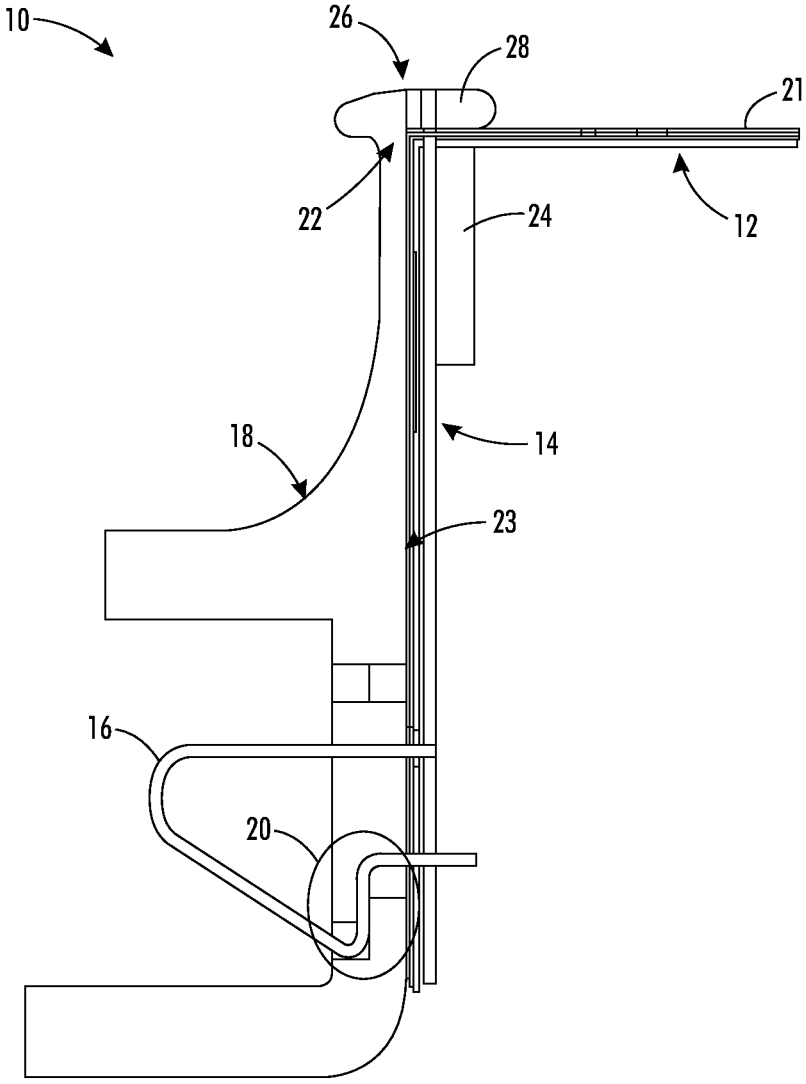
FIG. 1 illustrates a TAB assembly that includes a blade assembly that is held in place by a clamp assembly that includes one or more spring tabs, which mechanically couple the clamp assembly to an extrusion or assembly structure by interlocking with a series of interlocking features on the assembly structure.

FIG. 1 illustrates a TAB assembly 10 that includes a blade assembly 12 that is held in place by a clamp assembly 14 that includes one or more spring tabs 16, which mechanically couple the clamp assembly 14 to an extruded portion or structure 18 by interlocking with a series of interlocking features 20 on the extruded structure 18. The blade assembly 12 includes a blade edge 21 and a perforated portion 22, positioned between the blade assembly 12 and a mounted blade portion 23, wherein the perforation 22 permits the blade assembly to bend as it is held in place at approximately a 90° angle between the extruded portion 18 and the clamp assembly 14. The approximately 90° orientation of the blade assembly 12 is maintained by a block or bull-nose 24 on the clamp assembly 14.

During removal of the blade assembly 12, the spring tabs 16 are biased upward and released from the extruded portion 18, and the clamp assembly 14 is free to pivot or rotate about clamp pocket(s) 26, which in turn allows one or more respective clamp tabs 28 to disengage from the clamp pocket(s) 26.

Various features of the TAB assembly 10 contribute to cost savings and improved operation of the TAB assembly 10. For instance, the bull nose block 24 prevents blade distortion as it maintains the blade assembly 12 in a 90° configuration. The mitigated distortion in turn reduces dirt or other contamination on the blade proper 21. The spring tabs 16 replace conventional rivets, which can come loose, causing the blade proper 21 to increase substantially above the 90° blade angle, contaminating the blade proper 21, resulting in backside streaks on successive prints. The spring tabs 16 additionally facilitate replacement of the blade assembly 12 and reuse of the extruded portion 18 and clamp assembly 14, which are expensive parts of the TAB assembly 10 and are not reusable when the blade assembly 12 is riveted thereto.

The reusable TAB assembly 10, whereby the only component being replaced is the compliant blade assembly 12, reduces costs compared to a conventional assembly in which the entire high precision alignment/mounting structure requires replacement. That is, both the extruded portion 18 and the clamp assembly 14 are reusable, since these are relatively expensive parts due to high tolerance machining and since these components do not wear out over the life of the machine, as does the blade assembly. Therefore, the described TAB assembly includes features that allow for meeting the critical parameters as described above, such as maintaining the space constraint, reducing mass and providing a simple means for field replacement. Additionally, the extruded portion 18 includes both interlock features 20 and clamp pockets 26 that, through mechanically advantaged leverage, precisely nest the blade 21 into the proper position. The clamp assembly 14 includes the clamp tabs 28, the block 24, and a plurality of spring tabs 16 to further assist in maintaining the proper blade position. The spring design affords ease of assembly/disassembly. Additionally, the TAB assembly 10 provides significant cost savings over current design via single item replacement, in addition to ease of serviceability.

When the replaceable blade assembly 12 reaches its HFSI end of life (e.g., one million prints or some other predefined number of prints), a field service representative or other technician may replace the blade assembly. To do so, the spring tabs 16 are biased upwards, using a straight edge such as a ruler or the like, while pressing the back edge of the springs sideways. Alternatively, a ruler or other straight edge may be wedged between the extrusion 18 and the spring tabs 16, thereby concurrently unlocking and removing the clamp assembly 14. The lower edge of the clamp assembly 14 is now free to rotate about the clamp pockets until the spring(s) clear the interlock features, allowing the clamp tab(s) 28 to disengage from the clamp pocket(s) 26. The blade assembly 12 can now be removed and recycled as waste plastic. A replacement blade assembly is inserted into the extrusion 18 using the clamp assembly 14 as a guide, folding the blade assembly 12 along the perforated portion 22 coincident to a 90° upper edge of the extrusion. The clamp tab(s) 28 insert into the clamp pocket(s) 26, nesting the blade assembly against the extrusion. The clamp assembly 14 then pivots about this engagement until the spring tabs 16 snap into the extrusion/spring tab interlock feature(s) 20. The plurality of spring tabs 16 on the clamp assembly 14 lock the blade assembly in place, while the block or bull nose 24 biases the blade 21 against the 90° upper edge of the extrusion 18, thus maintaining the proper blade profile.

Figure 2:
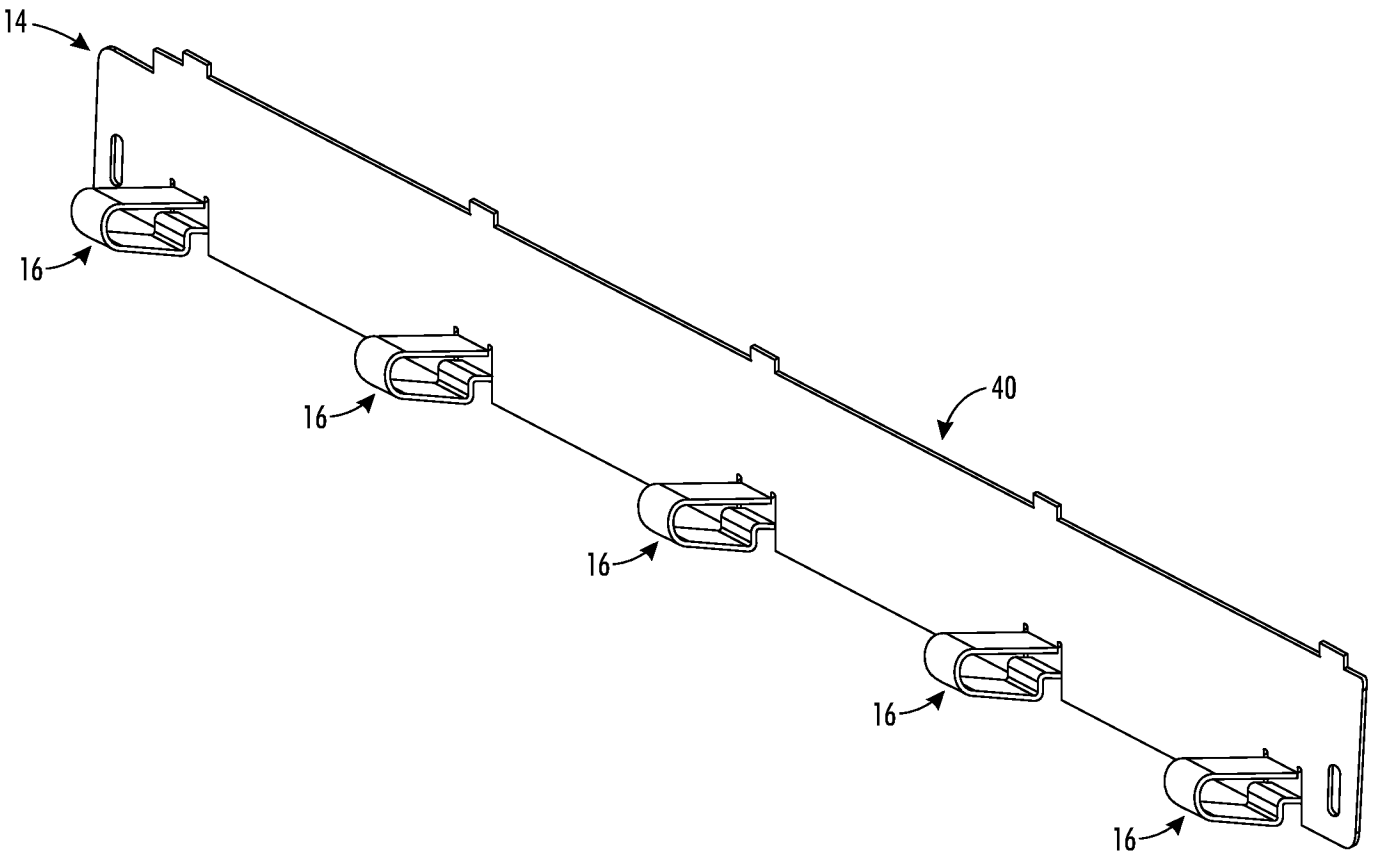
FIG. 2 illustrates an isometric view of the clamp assembly, in which a plurality of spring tabs is formed integrally with a main plate.

FIG. 2 illustrates an isometric view of the clamp assembly 14, in which a plurality of spring tabs 16 is formed integrally with a main plate 40. The spring tabs 16 are evenly spaced apart from one another along one edge of the main plate 40, in one example. In another example, the spring tabs are unevenly spaced. In another example, spacing between some spring tabs is even, while spacing between other spring tabs is uneven. When the spring tabs are locked into place with the extrusion (FIG. 1), the blade assembly is held in an operational position.

Figure 3:
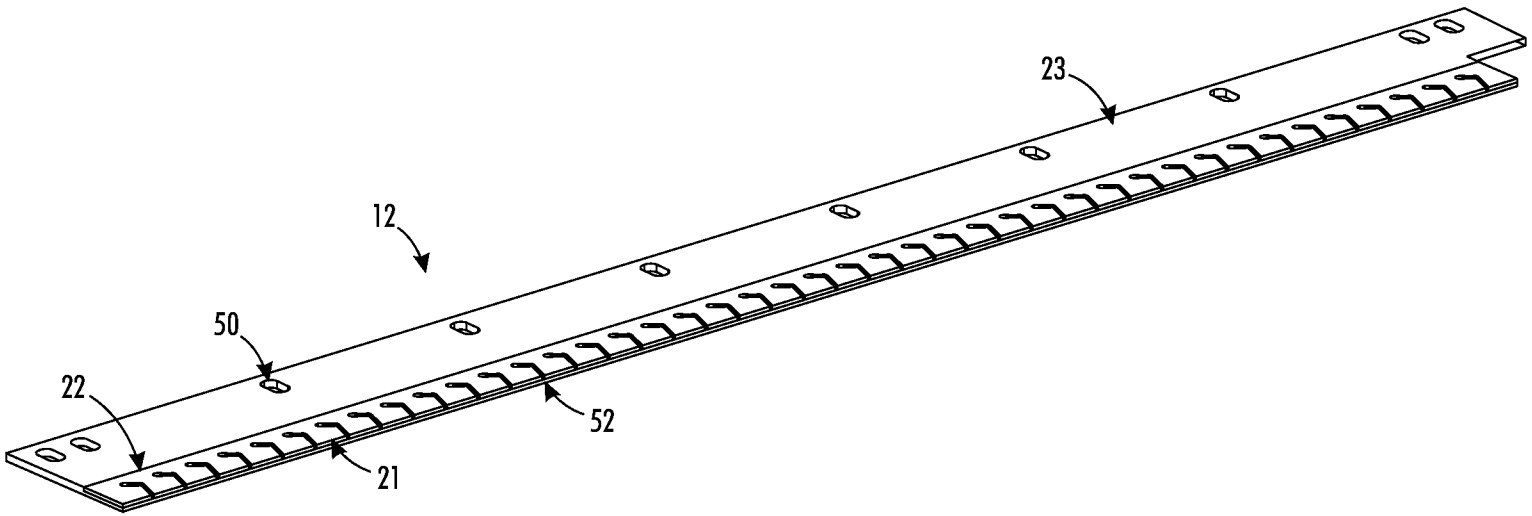
FIG. 3 illustrates an isometric view of the replaceable blade assembly.

FIG. 3 illustrates an isometric view of the replaceable blade assembly 12. The blade assembly includes the blade proper 21, the perforated portion 22 that allows the blade assembly 12 to be bent into an approximately 90° configuration when in place in the TAB assembly, and the mounted blade portion 23. The mounted blade portion 23 includes a plurality of holes or apertures 50 through which the spring tabs 16 (FIGS. 1 and 2) pass when the blade assembly 12 is mounted between the clamp assembly 14 and the extrusion 18. The blade proper 21 includes a plurality of slits 52 that divide an operational edge of the blade proper 21 into substantially equal portions or segments that permit the blade to differentially flex when pressed against a page, of predetermined width, to mitigate blade contamination, preventing backside streaks.

Figure 4:
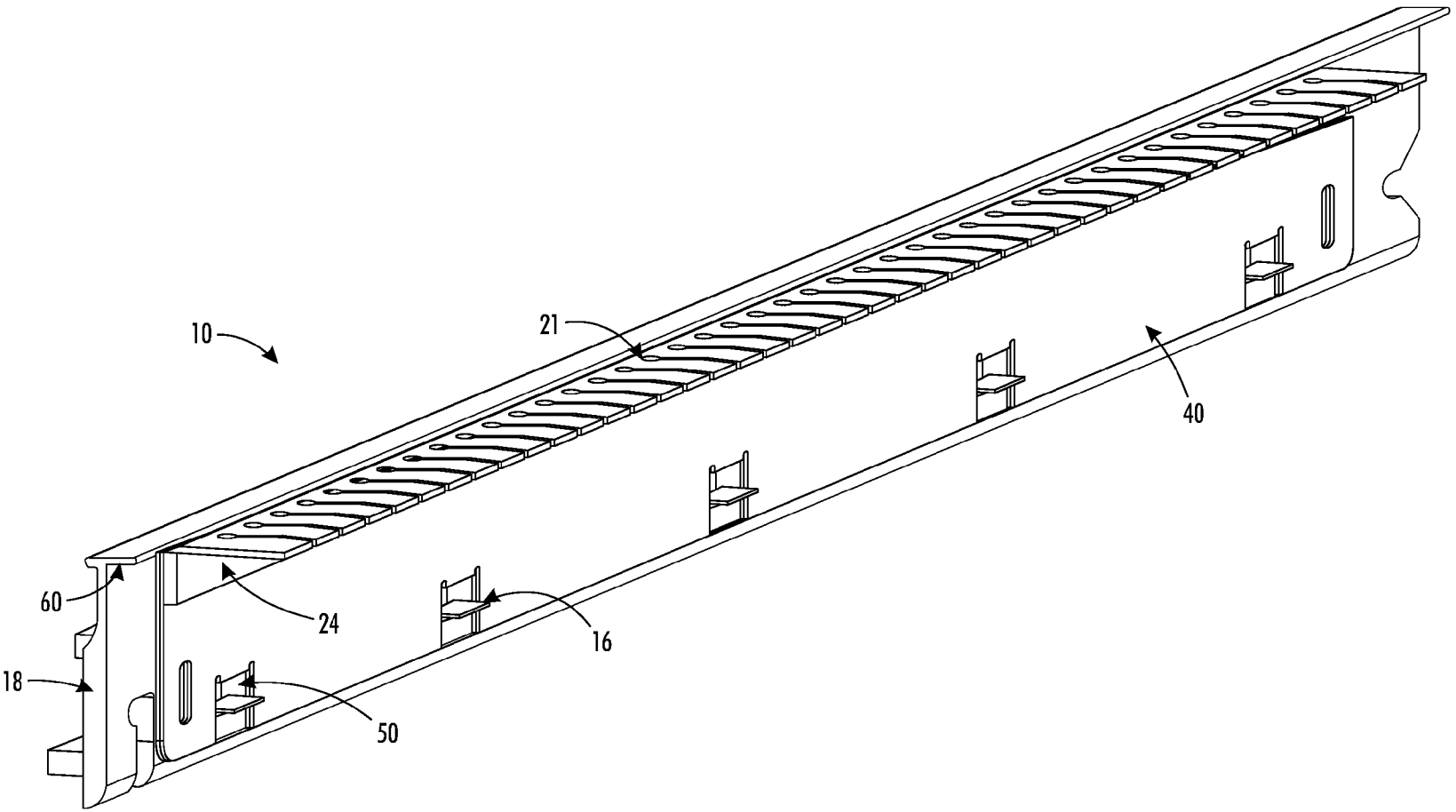
FIG. 4 illustrates a frontal isometric view of the TAB assembly.

FIG. 4 illustrates a frontal isometric view of the TAB assembly 10. The main plate 40 of the clamp assembly is mounted to the extrusion 18 via the spring tabs 16, which are positioned in the apertures 50. When in a locked position, the spring tabs 16 hold the main plate 40 in a position that sandwiches the blade assembly between the extrusion and the main plate 40. The blade proper 21 is held in its operational 90° orientation relative to the mounted blade portion by the block or bull nose portion 24, which pins the blade assembly against a 90° inner surface or face 60 of the extrusion 18.

Figure 5:
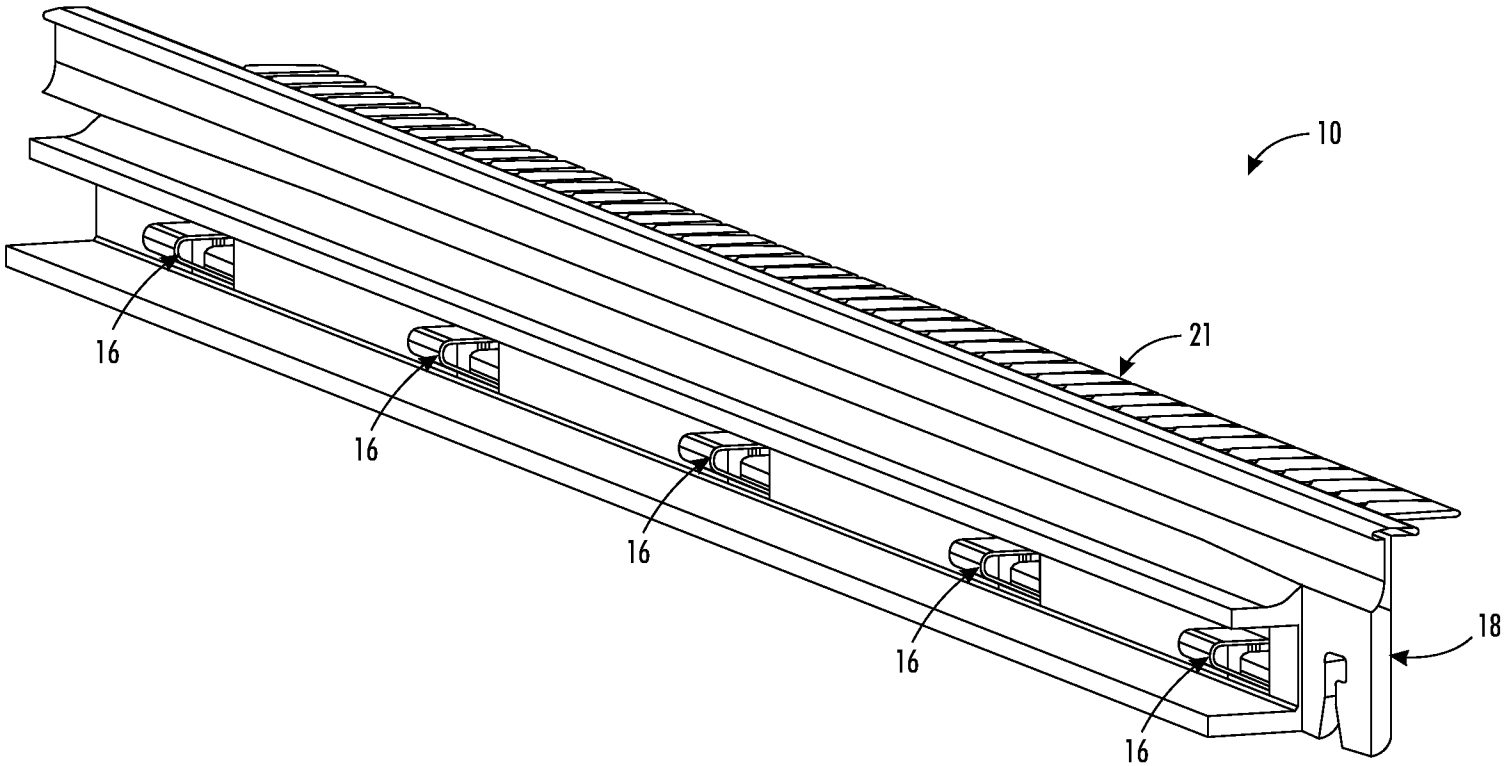
FIG. 5 is a rear isometric view of the TAB assembly.

FIG. 5 is a rear isometric view of the TAB assembly 10. The spring tabs 16 are in a locked position in the extrusion 18, holding the blade proper 21 in its operational position.

Figure 6:
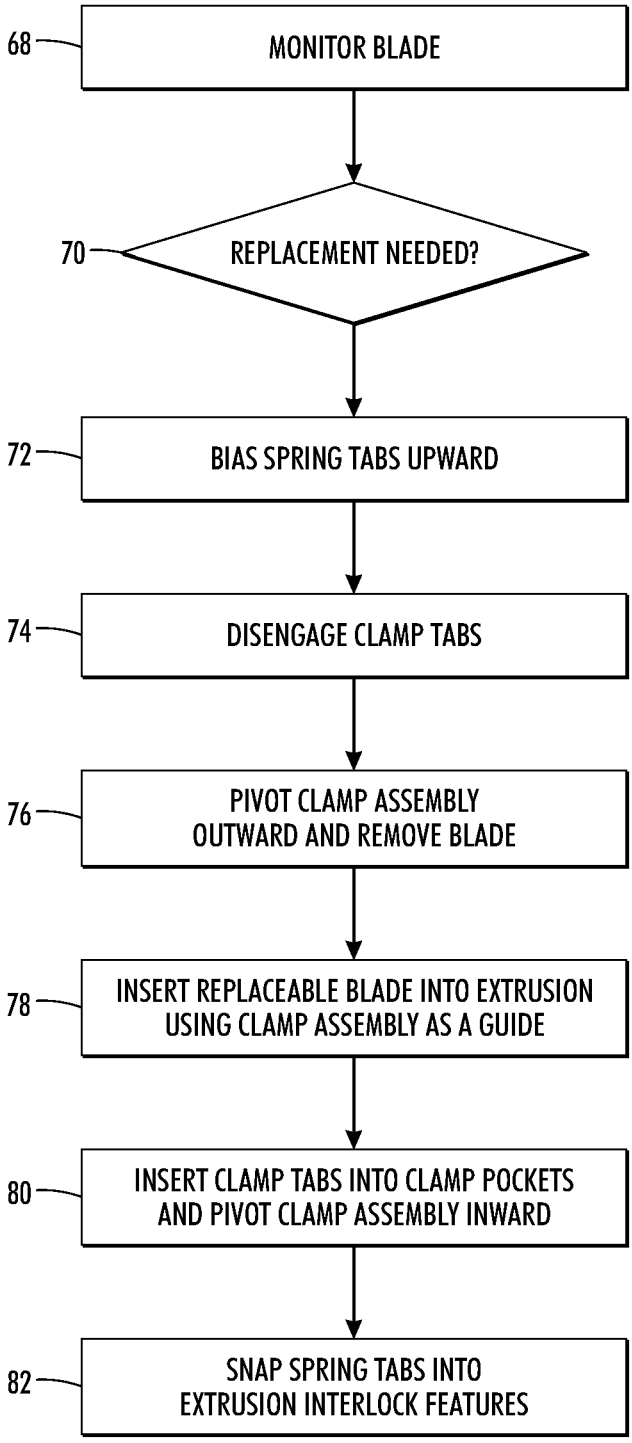
FIG. 6 illustrates a method for replacing the replaceable TAB in accordance with one or more aspects described herein.

FIG. 6 illustrates a method for replacing the replaceable TAB in accordance with one or more aspects described herein. At 68, blade wear is monitored. Blade wear may be monitored, for example, by visual inspection or by a counter that counts a number of prints or sheets that pass the blade. At 70, a determination is made that the replaceable blade assembly requires replacement. In one example the blade assembly requires replacement when it reaches its HFSI end of life (e.g., one million prints or some other predefined number of prints). In another example, the blade assembly is determined to require replacement upon visual inspection. In another example, the blade assembly is subject to periodic visual inspection (e.g., one a day, once a week, etc.) after reaching its HFSI end of life, and is only replaced upon the detection of visible defects on a printed page or on the blade itself. In yet another example, the blade is determined to require replacement prior to the HFSI end of life, upon detection of visible defects on a printed page or on the blade itself.

At 72, the spring tabs on the TAB assembly are biased upwards, using a straight edge ruler or other straight edged tool, while pressing the back edge of the springs sideways (e.g., to the right or left) relative to the top of the assembly shown in FIG. 1. Alternatively, a straight edged tool is wedged between a lower portion of the extrusion and the spring tab(s), while the spring tab(s) are pressed sideways. The lower portion of the clamp assembly is rotated about the clamp pockets until the spring tabs(s) clear the interlock features, allowing the clamp tab(s) to disengage from the camp pocket(s), at 74. At 76, the blade assembly is removed and optionally recycled as waste plastic. At 78, the replaceable blade is inserted into the extrusion using the clamp assembly as a guide, folding the blade along the perforated portion coincident to a 90° upper extrusion face. At 80, the clamp tab(s) are inserted into the clamp pocket(s), nesting the blade assembly against the extrusion. The clamp assembly rotates about this engagement until the spring tabs snap into the extrusion/spring interlock feature(s), at 82. The plurality of spring tabs on the clamp assembly bias the blade assembly against the 90° extrusion face, thus maintaining the proper blade profile.

The exemplary embodiments have been described with reference to the preferred embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

The invention claimed is:

1. A transfer assist blade (TAB) assembly, comprising:
- a replaceable blade assembly;
- an extruded portion against which the replaceable blade assembly is biased; and
- a clamp assembly comprising a plurality of spring tabs that releasably interlock with the extruded portion to secure the replaceable blade assembly in an operational position between the extruded portion and the clamp assembly;
- wherein the extruded portion includes a plurality of clamp pockets that receive a plurality of clamp tabs on the clamp assembly in order to align the clamp assembly to the extruded portion.

2. The TAB assembly according to claim 1, wherein the extruded portion has an inner face comprising an approximately 90° angle against which the blade assembly is biased.

3. The TAB assembly according to claim 2 wherein the clamp assembly comprises a bull nose block that biases the blade assembly against the inner face of the extruded portion.

4. The TAB assembly according to claim 3, wherein the replaceable blade assembly comprises:
- a blade proper that that asserts pressure against a sheet as it passes the blade proper;
- a mounted blade portion that is mounted between the clamp assembly and the extruded portion; and
- a perforated portion between the mounted blade portion and the blade proper, the perforated portion being flexible to create an approximately 90° angle between the mounted blade portion and the blade proper when biased against the inner face of the extruded portion.

5. The TAB assembly according to claim 1, wherein the extruded portion includes a plurality of sets of interlocking features that releasably lock the plurality of spring tabs into place and maintain the replaceable blade assembly and the clamp assembly in a locked position.

6. The TAB assembly according to claim 5, wherein the replaceable blade assembly comprises a plurality of apertures through which the plurality of spring tabs pass to interact with the plurality of interlocking features in order to lock the clamp assembly to the extruded portion.

7. The TAB assembly according to claim 1 wherein, wherein the replaceable blade assembly comprises:
- a blade proper that that asserts pressure against a print medium as it passes the blade proper;
- a mounted blade portion that is mounted between the clamp assembly and the extruded portion; and
- a perforated portion between the mounted blade portion and the blade proper, the perforated portion being flexible to create an approximately 90° angle between the mounted blade portion and the blade proper when biased against an inner face of the extruded portion.

8. The TAB assembly according to claim 7, wherein the replaceable blade assembly comprises a plurality of apertures through which the plurality of spring tabs pass and interact with a plurality of interlocking features on the extruded portion in order to lock the clamp assembly to the extruded portion.

9. The TAB assembly of claim 1 wherein the blade assembly is made of a recyclable plastic material.

10. The TAB assembly according to claim 9, wherein the clamp assembly pivots about the clamp pockets during locking and unlocking of the clamp assembly from the extruded portion.

11. A replaceable blade assembly for a transfer assist blade (TAB) assembly, comprising:
- a blade proper that applies pressure on a passing print medium during printing;
- a mounted blade portion with apertures therein through which a plurality of spring tabs on a clamp assembly pass, and which is removably mounted between the clamp assembly and an extruded portion of the TAB assembly; and
- a perforated portion between the mounted blade portion and the blade proper, the perforated portion being flexible to create an approximately 90° angle between the mounted blade portion and the blade proper when biased against an inner face of the extruded portion.

12. The replaceable blade assembly according to claim 11, further comprising a plurality of apertures through which the plurality of spring tabs on a clamp assembly are passed to interact with a plurality of interlocking features on the extruded portion in order to lock the clamp assembly to the extruded portion.

13. The replaceable blade assembly according to claim 11, wherein the blade assembly is made of a recyclable plastic material.

14. The replaceable blade assembly according to claim 11, wherein the extruded portion includes a plurality of clamp pockets that receive a plurality of clamp tabs on the clamp assembly in order to align the clamp assembly to the extruded portion, and wherein the blade assembly is aligned relative to the clamp assembly and the extruded portion by the spring tabs.

15. A method of replacing a blade assembly while reusing a transfer assist blade (TAB) assembly in which the TAB is mounted, comprising:

monitoring wear of a blade proper on the blade assembly;

determining that the blade assembly requires replacement;

biasing a plurality of spring tabs on a clamp assembly upward to disengage the spring tabs from a corresponding plurality of interlocking features on an extruded portion of the TAB assembly;

rotating the clamp assembly away from the extruded portion about one or more clamp pockets at a top of the extruded portion;

removing the blade assembly requiring replacement;

positioning a replacement blade assembly on the clamp assembly;

inserting a plurality of clamp tabs on the clamp assembly into the plurality of clamp pockets on the extruded portion;

rotating the clamp assembly toward from the extruded portion about the one or more clamp pockets at the top of the extruded portion; and snapping the spring tabs into the interlocking features to lock the replacement blade assembly in position between the clamp assembly and the extruded portion.

16. The method of claim 15, wherein determining that the blade requires replacement comprises visually inspecting the blade.

17. The method of claim 15, in determining that the blade requires replacement comprises determining that the blade has reached a high frequency service interval (HFSI) end-of-life.

18. The method of claim 17, wherein the HFSI end-of-life is reached when the blade assembly has experienced a predetermined number of prints.

19. The method of claim 15, wherein the blade assembly comprises:

the blade proper;

a mounted blade portion with apertures therein through which spring tabs on the clamp assembly pass, and which is removably mounted between the clamp assembly and the extruded portion of the TAB assembly; and a perforated portion between the mounted blade portion and the blade proper, the perforated portion being flexible to create an approximately 90° angle between the mounted blade portion and the blade proper when biased against an inner face of the extruded portion when the clamp assembly is locked to the extruded portion by the spring tabs.

* * * * *